US012644357B2

(12) United States Patent
Cockrill

(10) Patent No.: US 12,644,357 B2
(45) Date of Patent: Jun. 2, 2026

(54) TIME DELAYED ACTUATION OF WELL TOOL

(71) Applicant: WEATHERFORD TECHNOLOGY HOLDINGS, LLC, Houston, TX (US)

(72) Inventor: Christopher B. K. Cockrill, Aberdeen (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 18/733,254

(22) Filed: Jun. 4, 2024

(65) Prior Publication Data

US 2025/0361791 A1 Nov. 27, 2025

Related U.S. Application Data

(60) Provisional application No. 63/650,952, filed on May 23, 2024.

(51) Int. Cl.

| | |
|---|---|
| ***E21B 34/10*** | (2006.01) |
| ***E21B 23/04*** | (2006.01) |
| ***E21B 34/06*** | (2006.01) |
| *E21B 43/08* | (2006.01) |

(52) U.S. Cl.

CPC ..... *E21B 34/108* (2013.01); *E21B 23/04* (2013.01); *E21B 34/063* (2013.01); *E21B 43/08* (2013.01)

(58) Field of Classification Search

CPC ..... E21B 34/108; E21B 23/04; E21B 34/063; E21B 43/08

See application file for complete search history.

(56) References Cited

U.S. PATENT DOCUMENTS

| | | | | |
|---|---|---|---|---|
| 4,762,179 | A * | 8/1988 | Wesson | E21B 43/11855 175/4.56 |
| 5,992,520 | A | 11/1999 | Schultz et al. | |
| 7,775,283 | B2 | 8/2010 | Coronado et al. | |
| 9,010,442 | B2 | 4/2015 | Streich et al. | |

(Continued)

OTHER PUBLICATIONS

Baker Hughes, "4-1/2" CF Equalizer Helix with MTV (Multi Tasking Valve)," product presentation, dated 2009, 29 pages.

(Continued)

*Primary Examiner* — Nicole Coy
*Assistant Examiner* — Jennifer A Railey
(74) *Attorney, Agent, or Firm* — SMITH IP SERVICES, P.C.

(57) ABSTRACT

A well tool can include a well tool component, a release member, and an actuator comprising a piston, a flow restrictor, and a rupture disc that opens in response to application of a predetermined pressure to the piston. The flow restrictor meters fluid from one chamber to another chamber. The piston releases the release member in response to the fluid being metered between the chambers. A method of actuating a well tool can include applying a predetermined fluid pressure to a flow passage extending axially through the well tool, thereby opening a rupture disc of the well tool and metering fluid from one chamber to another chamber of the well tool, releasing a release member in response to the metering, thereby permitting displacement of a well tool component, and displacing the well tool component to an actuated position in response to the releasing.

16 Claims, 5 Drawing Sheets

(56) References Cited

U.S. PATENT DOCUMENTS

| | | | | |
|---|---|---|---|---|
| 9,080,404 | B2 | 7/2015 | Kalb et al. | |
| 9,121,247 | B2 | 9/2015 | George et al. | |
| 9,121,252 | B2 | 9/2015 | George et al. | |
| 9,217,309 | B2 | 12/2015 | Kalb et al. | |
| 9,273,535 | B1 * | 3/2016 | George | E21B 34/108 |
| 9,359,864 | B2 | 6/2016 | Harris et al. | |
| 9,816,352 | B2 | 11/2017 | Pickle et al. | |
| 10,138,725 | B2 | 11/2018 | George et al. | |
| 10,156,124 | B2 | 12/2018 | Guzman et al. | |
| 10,337,285 | B2 | 7/2019 | Kellner | |
| 10,364,647 | B2 | 7/2019 | Sargent et al. | |
| 11,261,682 | B2 | 3/2022 | Angman et al. | |
| 11,428,073 | B2 | 8/2022 | Mackay | |
| 11,702,904 | B1 | 7/2023 | Anton et al. | |
| 2014/0083720 | A1 * | 3/2014 | Kang | E21B 43/105 166/227 |
| 2021/0348478 | A1 | 11/2021 | Novelen et al. | |

OTHER PUBLICATIONS

Baker Hughes, "Equalizer Select AICD enabled production across 8600-ft open hole, saved $1.3 million USD," case study, 1 page, dated 2020.

Baker Hughes, "MTV hydraulically actuated device," webpage, 3 pages, accessed May 10, 2024.

Geodynamics, "SmartStartPLUS," product brochure, dated 2023, 2 pages.

Halliburton, "PetroGuard Screen and Equiflow ICD with Remote-Open Valve," product brochure, dated 2021, 2 pages.

HP Well Screen, "Data Sheet A1400837," product data sheet, undated, 1 page.

HP Well Screen, "Dissolvable Plugged Technology," product brochure, dated 2021, 13 pages.

Innovex Downhole Solutions, "To Activate Innovex Full-bore Masterflow ICDs (D) during the Clean Out Run:," user guide, dated 2018, 2 pages.

Innovex, ORIO 3D Toe Sleeve product brochure, dated Sep. 2021, 1 page.

Schlumberger, "ResFlow Inflow Control Device," product brochure, dated 2015, 4 pages.

Weatherford, "FloReg Inflow Control Device (ICD)," product brochure, 12 pages, dated 2010.

International Search Report with Written Opinion issued May 30, 2025 for PCT Patent Application No. PCT/IB2025/052827, 12 pages.

* cited by examiner

TIME DELAYED ACTUATION OF WELL TOOL

CROSS-REFERENCE TO RELATED APPLICATION

This application claims the benefit of the filing date of U.S. provisional application No. 63/650,952 filed on 23 May 2024. The entire disclosure of the prior application is incorporated herein by this reference for all purposes.

BACKGROUND

This disclosure relates generally to equipment utilized and operations performed in conjunction with a subterranean well and, in an example described below, more particularly provides for time delayed actuation of a well tool.

Various types of well tools can be actuated by increasing fluid pressure in a well. For example, a packer may be set or a sliding sleeve valve may be opened in response to application of a predetermined pressure level in a tubular string. Some well tools may be actuated by application of increased pressure to an annulus surrounding a tubular string.

Therefore, it will be readily appreciated that improvements are continually needed in the art of designing, constructing and utilizing well tools that are actuated by pressure. The disclosure below provides such improvements to the art, which improvements may be used with a variety of different types of well tools and a variety of different types of well environments and configurations.

DETAILED DESCRIPTION

Figure 1:
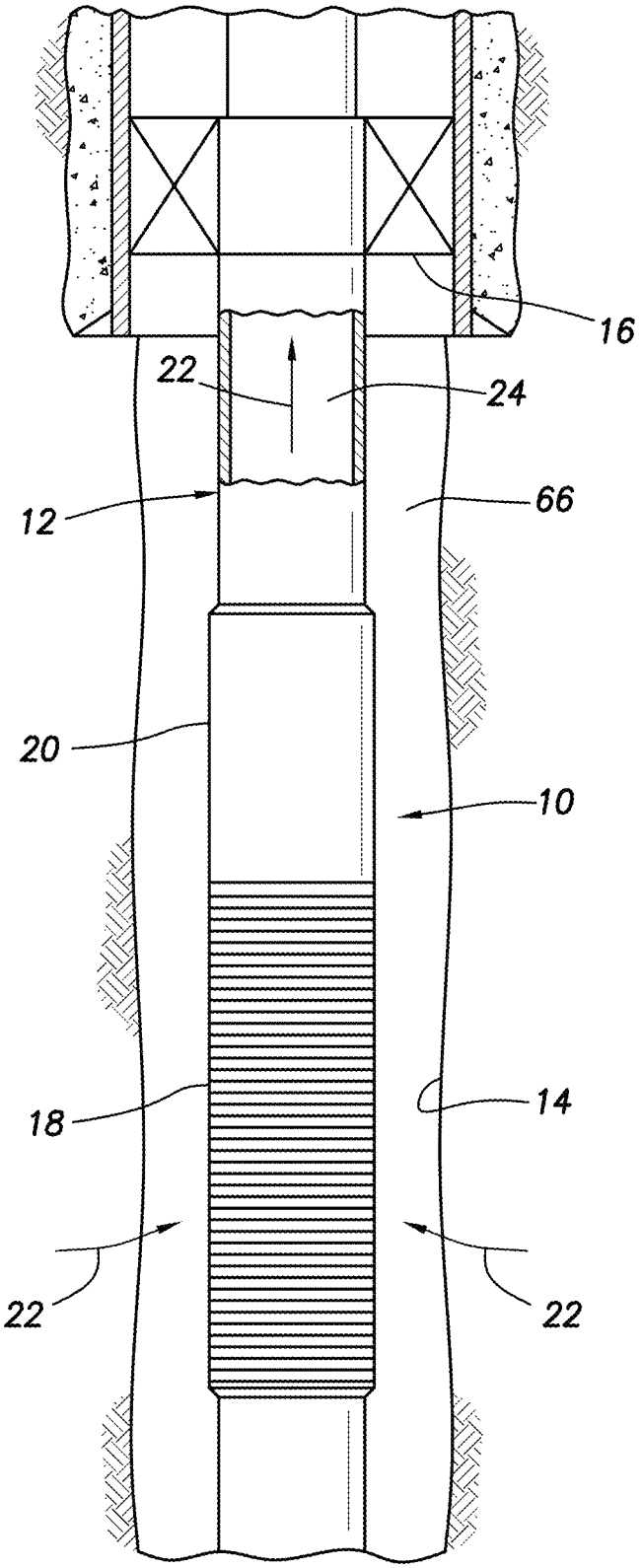
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14. An annulus 66 is formed radially between the tubular string 12 and the wellbore 14. The tubular string 12 is a production tubing string, but in other examples the tubular string could comprise drill pipe, liner, casing, an injection string, coiled tubing, conduit or any other type of tubular string.

As depicted in FIG. 1, a packer 16 and a well screen 18 are connected in the tubular string 12. The packer 16 is set in a cased section of the wellbore 14, and the well screen 18 is positioned in an uncased section of the wellbore. However, it is not necessary in keeping with the scope of this disclosure for any particular well tool to be positioned in a cased or uncased section of a wellbore.

In the FIG. 1 example, an inflow control valve 20 is connected in the tubular string 12. The inflow control valve 20 controls flow of well fluids 22 from the well screen 18 into the tubular string 12 for production to a surface of the well. The inflow control valve 20 is initially closed when the tubular string 12 is deployed into the wellbore 14, and then the inflow control valve is opened when it is desired to produce the fluids 22 through the well screen 18 into the tubular string 12.

In some examples, the inflow control valve 20 and the well screen 18 may be combined into a single well tool, instead of being considered separate well tools. The well screen 18/inflow control valve 20 is one example of a type of well tool that can incorporate the principles of this disclosure, but it should be understood that a wide variety of other different types of well tools (such as, packers, samplers, tester valves, frac valves, etc.) can benefit from the principles disclosed herein.

If the packer 16 is a hydraulically set packer, which is set in response to increased pressure applied to an interior of the tubular string 12, then the initial closed configuration of the inflow control valve 20 is desirable for applying the increased pressure to set the packer. After the packer 16 is set, the inflow control valve 20 can be opened to allow flow of the well fluids 22 into the tubular string 12 via the well screen 18. The well fluids 22 can then flow to the surface via a flow passage 24 that extends axially through the tubular string 12.

For a variety of different reasons, it is preferable for the inflow control valve 20 (and other types of well tools) to not be actuated when a relatively high pressure level has been applied in the well. One reason, in the case of the inflow control valve 20, is that the relatively high pressure would immediately be transmitted outward through the well screen 18, possibly damaging the well screen and/or an earth formation surrounding the wellbore 14. Seals can leak or be damaged when high pressure differentials are applied to the seals, particularly if the seals seal against moving well tool components. Well tool components can also be damaged, for example, due to impact loading caused by high pressure differentials. Other reasons exist, as well, depending on the type of well tool being actuated. For example, it is typically desirable for a packer to be set relatively slowly, to allow its seal elements to fully and uniformly compress.

In the FIG. 1 example, the inflow control valve 20 includes features that enable the valve to be actuated from its closed configuration to its open configuration after fluid pressure in the tubular string 12 has been increased. There is a time delay between the pressure being increased to a certain level and actuation of the inflow control valve 20 to its open configuration. In this manner, the packer 16 can be set by increasing the pressure in the tubular string 12 (and/or other well tools in the tubular string can be actuated by the increased pressure), and then the inflow control valve 20 can be opened after the pressure in the tubular string has been reduced.

Figure 2:
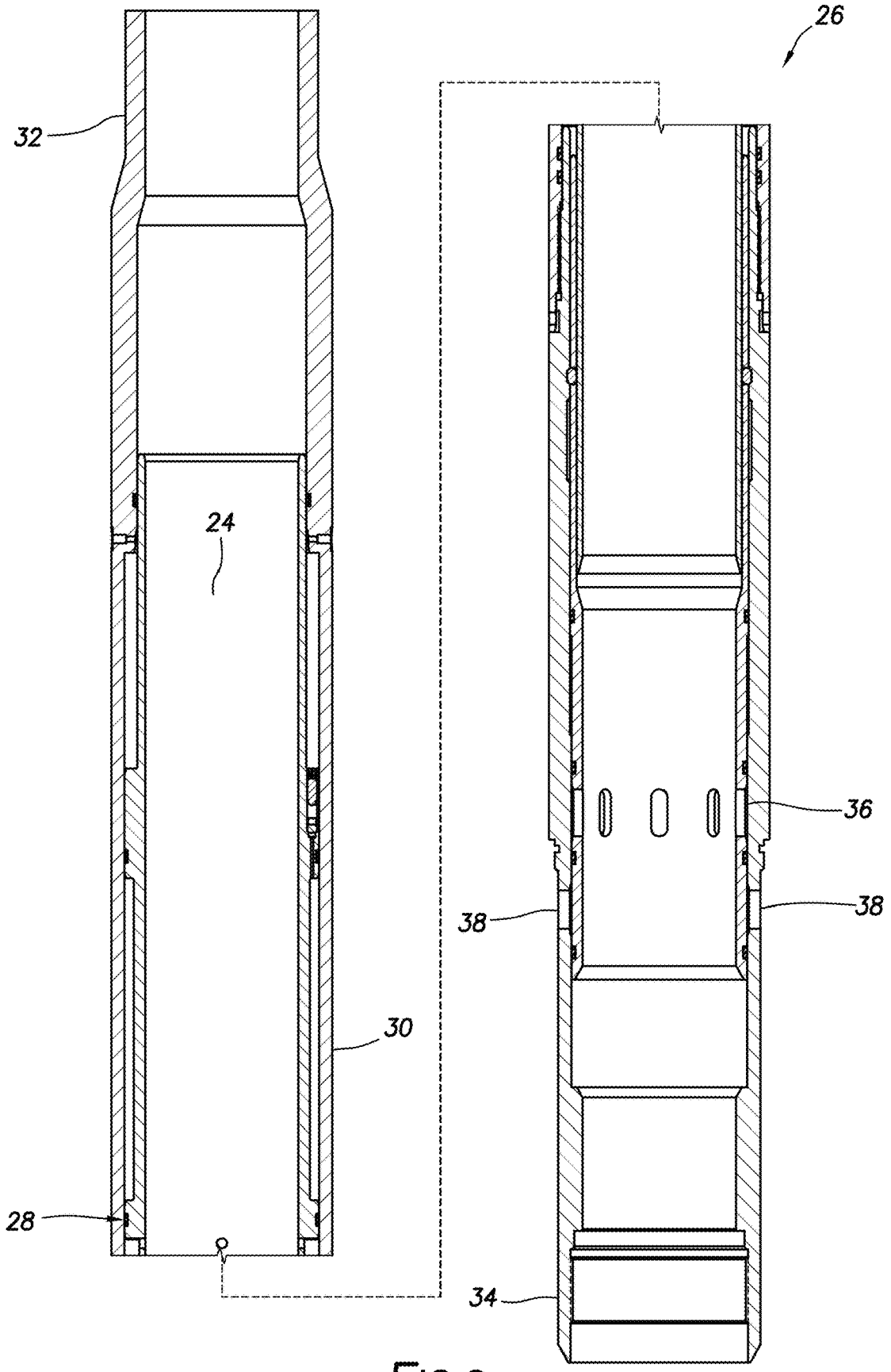
FIG. 2 is a representative cross-sectional view of an example of a well tool and actuator that may be used in the FIG. 1 system and method.

Referring additionally now to FIG. 2, a cross-sectional view of an example of a well tool 26 with an actuator 28 that may be used in the FIG. 1 system 10 and method is representatively illustrated. The FIG. 2 well tool 26 may be used for the inflow control device 20 in the FIG. 1 system 10 and method, or it may be used with other systems and methods. For clarity and convenience, the well tool 26 is described below as it may be used in the system 10 and method.

In the FIG. 2 example, the well tool 26 includes an outer housing 30 with upper and lower connectors 32, 34 for connecting the well tool in a tubular string (such as the FIG. 1 tubular string 12). When connected in the tubular string 12, the flow passage 24 extends axially through the well tool 26. The outer housing 30 can be made up of any number of individual section(s). The scope of this disclosure is not limited to any particular configuration or arrangement of any of the elements of the well tool 26.

The actuator 28 is contained in the outer housing 30. The actuator 28 is used in this example to control displacement of a well tool component 36. The well tool component 36 is initially prevented from displacing relative to the outer housing 30 in the run-in configuration of the well tool 26, but the actuator releases the well tool component for displacement an amount of time after a predetermined fluid pressure is applied to the flow passage 24, as described more fully below.

In the FIG. 2 example, the well tool component 36 comprises a sleeve that is slidingly and sealingly disposed in the outer housing 30. The sleeve initially blocks flow through one or more ports 38 formed through the outer housing 30. The ports 38 receive the filtered well fluids 22 from the well screen 18 (see FIG. 1).

When the sleeve is displaced downward (as viewed in the figures), the sleeve will no longer block the flow of the well fluids 22 through the ports 38. The well fluids 22 can then flow into the flow passage 24 and to the surface via the tubular string 12.

In other examples, the well tool component 36 could be another type of well tool component. For example, the well tool component 36 could be a packer mandrel, an injector valve flow tube, a reamer mandrel, or any other type of well tool component.

Figure 3:
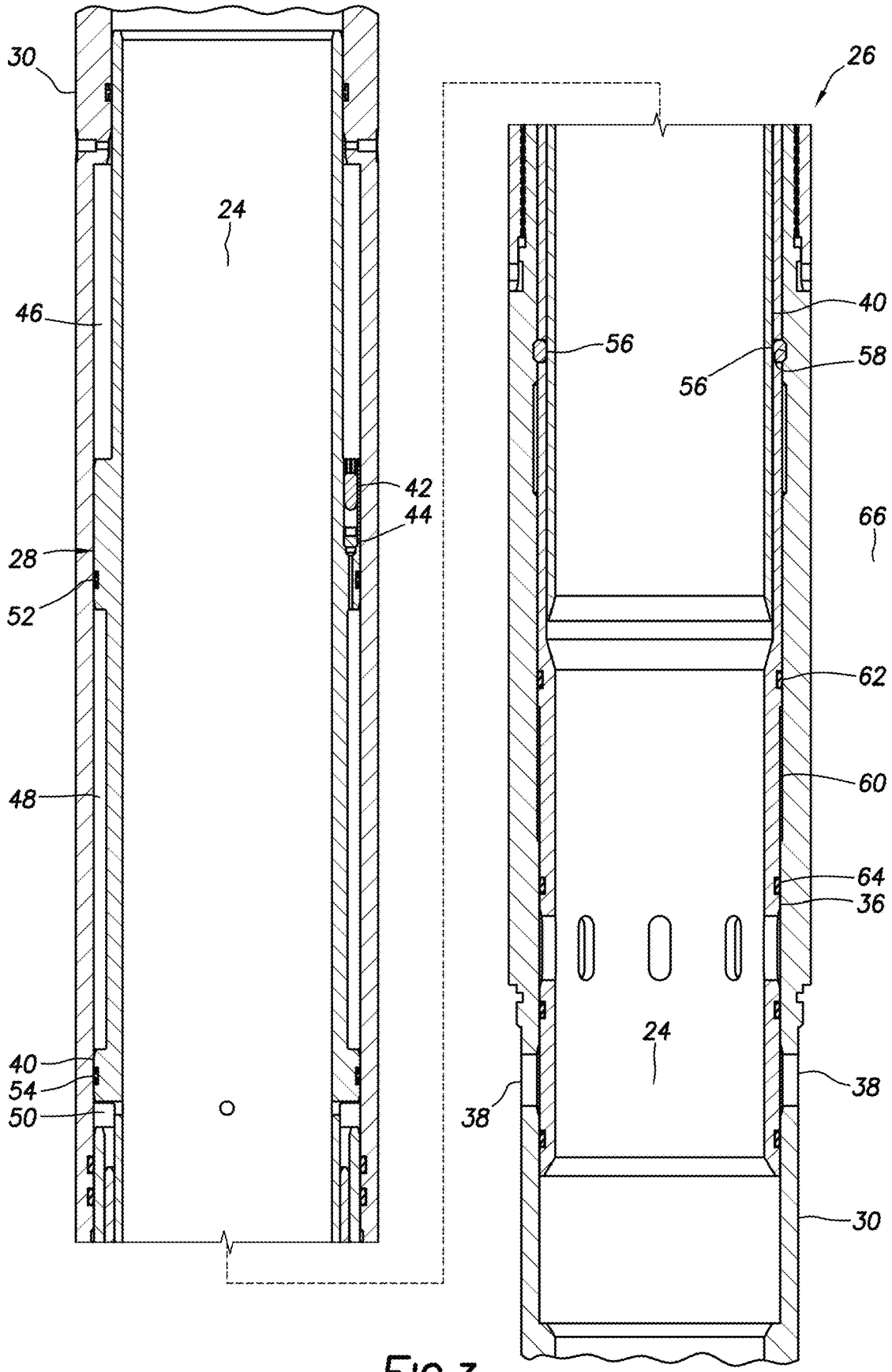
FIG. 3 is a representative cross-sectional view of the well tool and actuator in a run-in configuration.

Referring additionally now to FIG. 3, a cross-sectional view of the well tool 26 and actuator 28 in a run-in configuration is representatively illustrated. Only a central section of the well tool 26 is depicted in FIG. 3.

In this example, the actuator 28 includes an annular piston 40, a flow restrictor 42 and a rupture disc 44. The piston 40 is slidingly and sealingly received in the outer housing 30, so that annular chambers 46, 48, 50 are formed radially between the piston and the outer housing.

The chamber 50 is in fluid communication with the flow passage 24. The chamber 48 in this example initially contains a gas at relatively low pressure (such as, air at atmospheric pressure). The chamber 46 in this example initially contains a relatively incompressible fluid (such as, hydraulic fluid) suitable for metering through the flow restrictor 42.

The chamber 48 is disposed axially between seals 52, 54 that seal between the outer housing 30 and the piston 40. The seal 54 isolates the chamber 48 from the chamber 50 and forms an outer periphery of a piston area acted on by the fluid pressure in the chamber 50. Thus, the fluid pressure in the chamber 50 (and in the flow passage 24) biases the piston 40 upward (as viewed in FIG. 3).

In the FIG. 3 run-in configuration, the piston 40 cannot displace upward, due to the relatively incompressible fluid contained in the chamber 46. The rupture disc 44 initially prevents the fluid from flowing out of the chamber 46 and into the chamber 48. As a result, fluid pressure in the chamber 46 increases to balance the pressure in the chamber 50.

The rupture disc 44 is exposed to a pressure differential between the chambers 46, 48. When the pressure differential reaches a predetermined level (due to a corresponding predetermined fluid pressure being applied to the flow passage 24), the rupture disc 44 will rupture and thereby permit the fluid to flow from the chamber 46 to the chamber 48 via the flow restrictor 42.

In the FIG. 1 system 10 and method, the rupture disc 44 can be selected to permit one or more other well tools (such as, the packer 16) to be actuated with pressure(s) applied to the flow passage 24, with those pressure(s) being less than the predetermined pressure required to rupture the rupture disc. Then, when it is desired to actuate the well tool 26, the fluid pressure in the flow passage 24 can be increased to the predetermined level to rupture the rupture disc 44. This will initiate actuation of the well tool 26.

As depicted in FIG. 3, a lower portion of the piston 40 radially outwardly supports one or more release members 56 in engagement with an annular recess 58 formed in the outer housing 30. In this example, the release members 56 are in the form of dogs that extend radially through an upper portion of the well tool component 36. In this manner, displacement of the well tool component 36 relative to the outer housing 30 is initially prevented.

In other examples, the release members 56 may not be in the form of dogs. For example, the release members 56 could be in the form of collets, a latch, a snap ring, etc.

In the FIG. 3 example, when the piston 40 displaces upward a sufficient distance, the piston will no longer outwardly support the release members 56, and the release members will be permitted to displace radially inward and out of engagement with the recess 58.

An annular chamber 60 is formed radially between the well tool component 36 and the outer housing 30. The chamber 60 is also formed axially between seals 62, 64 that seal between the well tool component 36 and the outer housing 30. In this example, the chamber 60 contains gas at a relatively low pressure (such as, air at atmospheric pressure).

The seals 62, 64 have different outer diameters, so that a piston area is formed on the well tool component 36. Thus, fluid pressure in the flow passage 24 biases the well tool component 36 upward.

Figure 4:
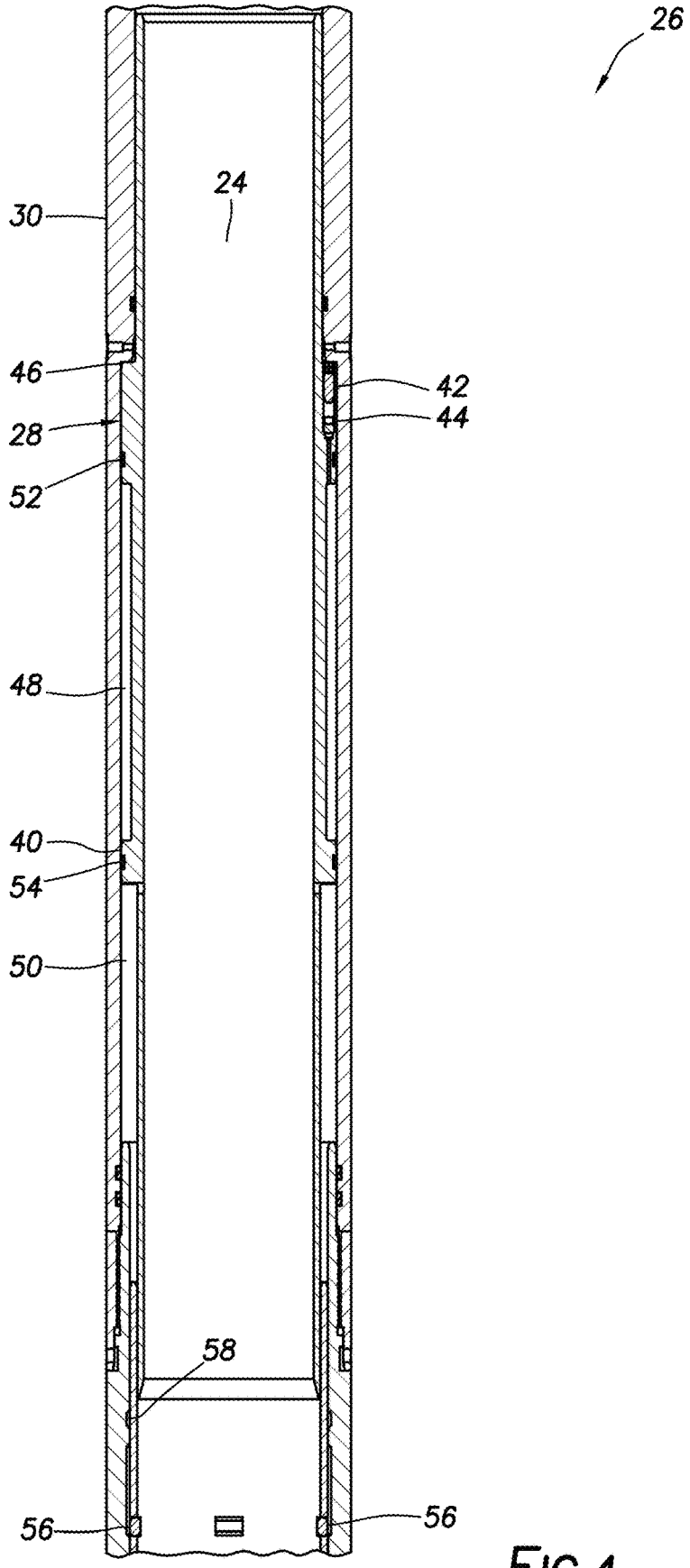
FIG. 4 is a representative cross-sectional view of an upper section of the well tool and actuator in an actuated configuration.

Referring additionally now to FIG. 4, a cross-sectional view of an upper section of the well tool 26 and actuator 28 in an actuated configuration is representatively illustrated. In this view, the predetermined fluid pressure has been applied to the flow passage 24, so that the rupture disc 44 has ruptured.

The fluid previously in the chamber 46 has been metered into the chamber 48 via the flow restrictor 42. The metering of the fluid through the flow restrictor 42 produces a time delay between the opening of the rupture disc 44 and sufficient upward displacement of the piston 40 to release the release members 56. During this time delay, the pressure in the flow passage 24 can be decreased as desired, although such reduction in pressure is not required for operation of the well tool 26.

As depicted in FIG. 4, the piston 40 has displaced upward as the fluid has been metered through the flow restrictor 42 from the chamber 46 to the chamber 48, so that the chamber 46 is substantially compressed, and the chamber 48 displaces upward with the piston. Due to the upward displacement of the piston 40, the release members 56 are no longer supported in engagement with the recess 58, and the release members are radially inwardly displaced. With the release members 56 no longer engaged with the recess 58, the well tool component 36 is permitted to displace downwardly relative to the outer housing 30.

Figure 5:
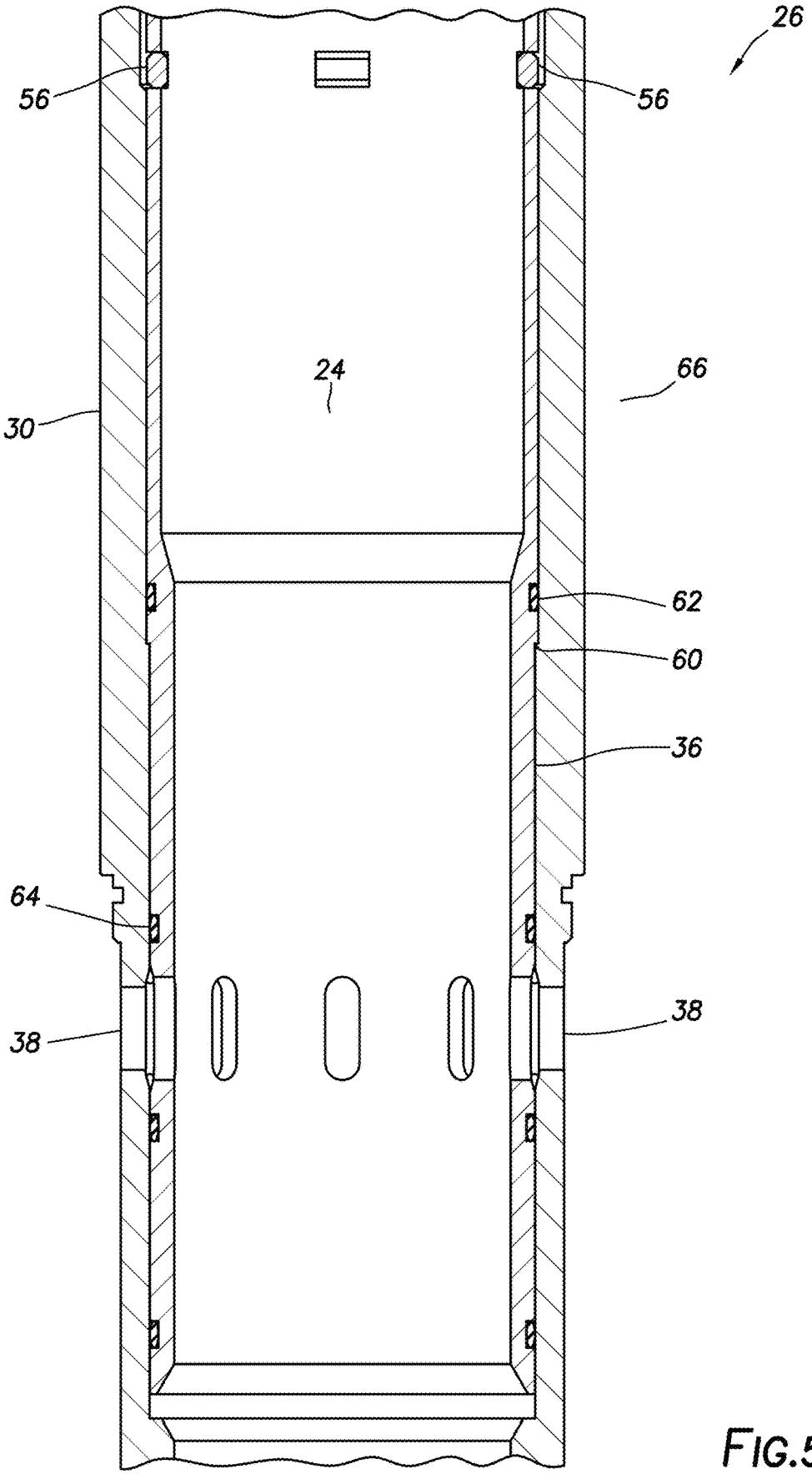
FIG. 5 is a representative cross-sectional view of a lower section of the well tool and actuator in the actuated configuration.

Referring additionally now to FIG. 5, a cross-sectional view of a lower section of the well tool 26 and actuator 28 in the actuated configuration is representatively illustrated. In this view, it may be seen that the well tool component 36 has been displaced downwardly relative to the outer housing 30. The well tool component 36 is displaced downward, even if the pressure in the flow passage 24 has been reduced after application of the predetermined fluid pressure, as described above.

As depicted in FIG. 5, the well tool component 36 no longer blocks fluid flow from the well screen 18 (see FIG. 1) into the flow passage 24 via the ports 38. The downward displacement of the well tool component 36 has substantially compressed the chamber 60.

Note that the displacement of the well tool component 36 to its FIG. 5 open position occurs an amount of time after the rupture disc 44 has been opened (due to application of the predetermined pressure to the flow passage 24), as described above. This amount of time, or time delay, is determined by a number of factors, each of which can be varied as desired to produce a corresponding desired time delay. For example, a viscosity of the fluid initially in the chamber 46, a restriction to flow through the flow restrictor 42, a volume of the fluid metered between the chambers 46, 48 to produce a given displacement of the piston 40, a piston area of the piston 40, etc., may be varied to change the length of the time delay.

It may now be fully appreciated that the above disclosure provides significant advancements to the art of designing, constructing and utilizing well tools that are actuated by pressure. In an example described above, a time delay is provided between initiating actuation of the well tool 26 and displacing the well tool component 36 to its actuated position. This time delay allows fluid pressure in the flow passage 24 to be reduced, prior to fluid communication being permitted through the ports 38.

The above disclosure provides to the art a well tool 26 for use with a subterranean well. In one example, the well tool 26 can comprise a well tool component 36, a release member 56 that releasably secures the well tool component 36 against displacement, and an actuator 28 comprising a piston 40, a flow restrictor 42, and a rupture disc 44 configured to open in response to application of a predetermined pressure to the piston 40. The flow restrictor 42 is configured to meter fluid from a first chamber 46 to a second chamber 48. The piston 40 is configured to release the release member 56 in response to the fluid being metered from the first chamber 46 to the second chamber 48.

The rupture disc 44 may be disposed in the piston 40. The flow restrictor 42 may be disposed in the piston 40.

The second chamber 48 may be configured for displacement with the piston 40. The second chamber 48 may be formed in an annular space radially between the piston 40 and an outer housing 30 of the well tool 26, and axially between annular seals 52, 54 that seal between the piston 40 and the outer housing 30.

The well tool component 36 may comprise a sleeve having a first position in which the sleeve blocks fluid flow through a port 38, and a second position in which the sleeve does not block fluid flow through the port 38. The release member 56 may comprise a dog that extends through a wall of the sleeve into engagement with a recess 58 formed in an outer housing 30 that surrounds the sleeve. The piston 40 may radially outwardly support the dog in engagement with the recess 58.

Also provided to the art by the above disclosure is a method of actuating a well tool 26 in a subterranean well. In one example, the method can comprising: applying a predetermined fluid pressure to a flow passage 24 extending axially through the well tool 26, thereby opening a rupture disc 44 of the well tool 26 and metering fluid from a first chamber 46 of the well tool 26 to a second chamber 48 of the well tool 26; releasing a release member 56 in response to the fluid metering, thereby permitting displacement of a well tool component 36; and displacing the well tool component 36 to an actuated position in response to the releasing.

The method may include reducing the fluid pressure in the flow passage 24 prior to the releasing step. The displacing step may include the reduced fluid pressure displacing the well tool component 36 to the actuated position.

The displacing step may include permitting fluid flow between the flow passage 24 and an annulus 66 surrounding the well tool 26.

The releasing step may include permitting disengagement of the release member 56 from an outer housing 30 surrounding the well tool component 36.

The metering step may include flowing the fluid through a flow restrictor 42 disposed in a piston 40 of the well tool 26. The metering step may also include displacing the second chamber 48 with the piston 40.

A system 10 for use with a subterranean well is provided to the art by the above disclosure. In one example, the system 10 can comprise: a well screen 18 configured to filter flow from an annulus 66 surrounding the well screen 18 into an internal flow passage 24 of a tubular string 12 in which the well screen 18 is connected; and a well tool 26 that initially prevents fluid flow from the well screen 18 into the flow passage 24, the well tool 26 being configured to permit the fluid flow from the well screen 18 into the flow passage 24 an amount of time after a predetermined fluid pressure is applied to the flow passage 24. The amount of time is determined by a predetermined volume of fluid metered from a first chamber 46 to a second chamber 48 of the well tool 26.

The second chamber 48 may be configured for displacement with a piston 40 of the well tool 26. The second chamber 48 may be formed in an annular space radially between the piston 40 and an outer housing 30 of the well tool 26, and axially between annular seals 52, 54 that seal between the piston 40 and the outer housing 30.

The well tool 26 may include a piston 40, a well tool component 36, and a release member 56 that releasably secures the well tool component 36 against displacement. The piston 40 may be configured to displace as the fluid meters from the first chamber 46 to the second chamber 48. The release member 56 may be configured to release in response to the piston 40 displacement.

The well tool 26 may include a flow restrictor 42 configured to meter the fluid from the first chamber 46 to the second chamber 48. The flow restrictor 42 may be disposed in the piston 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool for use with a subterranean well, the well tool comprising:

a well tool component;

a release member that releasably secures the well tool component against displacement; and an actuator comprising a piston, a flow restrictor, and a rupture disc configured to open in response to application of a predetermined pressure to the piston, in which the flow restrictor is configured to meter fluid from a first chamber to a second chamber, in which the piston is configured to release the release member in response to the fluid being metered from the first chamber to the second chamber, and in which the second chamber is configured for displacement with the piston.

2. The well tool of claim 1, in which the rupture disc is disposed in the piston.

3. The well tool of claim 1, in which the second chamber is formed in an annular space radially between the piston and an outer housing of the well tool, and axially between annular seals that seal between the piston and the outer housing.

4. The well tool of claim 1, in which the flow restrictor is disposed in the piston.

5. The well tool of claim 1, in which the well tool component comprises a sleeve having a first position in which the sleeve blocks fluid flow through a port, and a second position in which the sleeve does not block fluid flow through the port.

6. The well tool of claim 5, in which the release member comprises a dog that extends through a wall of the sleeve into engagement with a recess formed in an outer housing that surrounds the sleeve.

7. The well tool of claim 6, in which the piston radially outwardly supports the dog in engagement with the recess.

8. A method of actuating a well tool in a subterranean well, the method comprising:

applying a predetermined fluid pressure to a flow passage extending axially through the well tool, thereby opening a rupture disc of the well tool and metering fluid from a first chamber of the well tool to a second chamber of the well tool;

releasing a release member in response to the fluid metering, thereby permitting displacement of a well tool component; and displacing the well tool component to an actuated position in response to the releasing, in which the metering comprises flowing the fluid through a flow restrictor disposed in a piston of the well tool, and in which the metering further comprises displacing the second chamber with the piston.

9. The method of claim 8, further comprising reducing the fluid pressure in the flow passage prior to the releasing.

10. The method of claim 9, in which the displacing comprises the reduced fluid pressure displacing the well tool component to the actuated position.

11. The method of claim 8, in which the displacing comprises permitting fluid flow between the flow passage and an annulus surrounding the well tool.

12. The method of claim 8, in which the releasing comprises permitting disengagement of the release member from an outer housing surrounding the well tool component.

13. A system for use with a subterranean well, the system comprising:

a well screen configured to filter flow from an annulus surrounding the well screen into an internal flow passage of a tubular string in which the well screen is connected; and a well tool that initially prevents fluid flow from the well screen into the flow passage, the well tool being configured to permit the fluid flow from the well screen into the flow passage an amount of time after a predetermined fluid pressure is applied to the flow passage, in which the amount of time is determined by a predetermined volume of fluid metered from a first chamber to a second chamber of the well tool, and in which the second chamber is configured for displacement with a piston of the well tool.

14. The system of claim 13, in which the second chamber is formed in an annular space radially between the piston and an outer housing of the well tool, and axially between annular seals that seal between the piston and the outer housing.

15. The system of claim 13, in which the well tool comprises a piston, a well tool component, and a release member that releasably secures the well tool component against displacement, in which the piston is configured to displace as the fluid meters from the first chamber to the second chamber, and in which the release member is configured to release in response to the piston displacement.

16. The system of claim 15, in which the well tool further comprises a flow restrictor configured to meter the fluid from the first chamber to the second chamber, and in which the flow restrictor is disposed in the piston.

* * * * *